United States Patent [19]

Eldridge, Jr. et al.

[11] 4,011,693

[45] Mar. 15, 1977

[54] CLEANER FOR CAUTERIZING IMPLEMENTS

[76] Inventors: John D. Eldridge, Jr., 310 S. Bayfront, Balboa Island, Calif. 92662; William D. DeMayo, 511 Hazel Drive, Corona Del Mar, Calif. 92625

[22] Filed: Feb. 9, 1976

[21] Appl. No.: 656,417

Related U.S. Application Data

[63] Continuation-in-part of Ser. No. 567,627, April 14, 1975, Pat. No. 3,982,357.

[52] U.S. Cl. ..... 51/354; 15/218.1; 128/303.17

[51] Int. Cl.[2] ..... B24D 15/08

[58] Field of Search ..... 51/358, 330, 352, 354, 51/362, 150, 151, 23, 25; 128/303, 303.17; 15/218.1, 210 B

[56] References Cited

UNITED STATES PATENTS

| | | | |
|---|---|---|---|
| 836,189 | 11/1906 | Hutchinson | 15/218.1 |
| 2,262,401 | 11/1941 | Meade | 51/354 |
| 2,719,313 | 10/1955 | Smith | 15/218.1 X |

*Primary Examiner*—Al Lawrence Smith
*Assistant Examiner*—Nicholas P. Godici
*Attorney, Agent, or Firm*—Lyon & Lyon

[57] ABSTRACT

A cleaner for cauterizing implements, involving a mounting member one side of which is adapted to be secured by pressure sensitive adhesive to a surgical towel or drape and the other side being provided with upstanding parallel backing strips between which is a pair of mutually adhering flat magnet elements. The magnet elements and backing strips are covered by an abrasive material so that a cauterizing knife or forcep may be inserted between the magnet elements or wiped against the exposed surfaces.

4 Claims, 9 Drawing Figures

CLEANER FOR CAUTERIZING IMPLEMENTS

This application is a continuation in part U.S. application Ser. No. 567,627; filed Apr. 14, 1975, now U.S. Pat. No. 3,982,357 for CLEANING DEVICE FOR CAUTERIZING KNIVES.

BACKGROUND

Various knife or razor blade polishing and cleaning devices involve opposed abrasive surfaces urged toward each other by spring force; samples of such devices are disclosed in U.S. Pat. Nos. 836,189; 1,096,354; 2,648,858 and 3,372,419; and in British Pat. No. 439,086. If the cauterizing implement is flat, similar to a knife or razor blade, the devices disclosed in the above listed patents may be satisfactory, but are not suited for cleaning surgical instruments such as cauterizing forceps, as the closing force increases as the surfaces are separated, resulting excessive force being applied to the cleaning device.

SUMMARY

The present invention is directed to a cleaner for cauterizing implements which is adapted for cleaning surgical implements including cauterizing forceps, and is summarized in the following objects:

First, to provide a cleaner for cauterizing implements, wherein opposed abrasive surfaces are urged toward each other by magnetic force which decreases in strength as the spacing between the abrasive surfaces increases, so that a cauterizing forcep or the like may spread the abrasive surfaces while reducing rather than increasing the force required to operate the cleaner.

Second, to provide a cleaner for cauterizing implements, as indicated in the preceeding object is arranged to be mounted on a surgical towel or drape by pressure sensitive adhesive, without danger of being forced free of the towel or drape when used to clean cauterizing forceps.

Third, to provide a cleaner for cauterizing implements which may be made at minimum expense, and thus be discarded after use.

DETAILED DESCRIPTION

Figure 1:
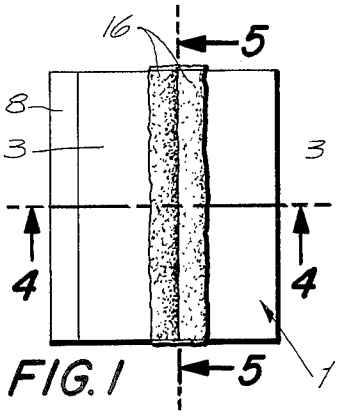
FIG. 1 is a plan view of the cleaner for cauterizing implements.

The cleaner for cauterizing implements includes a mounting member 1 which may be formed of cardboard if provided with an appropriate coating, or may be formed of plastic material capable of being folded. The mounting member includes a mounting panel 2 which is rectangular and provided at two sides with side portions 3 joined thereto by a foldable connections 4. Each side portion is joined by a foldable connection 5 to a web portion 6.

The side portions 3 are folded over the panel 2 in such a manner that the web portions 6 occupy an upstanding position.

The mounting panel 2 is provided with a coating of a pressure sensitive adhesive 7, initially provided with a protective cover sheet 8.

The confronting sides of the web portions 6 are provided with magnet units 9, each magnet unit including a metal backing strip 10 cemented or otherwise attached to the web portion and a magnet strip 11 cemented or otherwise attached to the backing strip.

It has been found preferable to use magnets formed of sintered magnetic particles bonded together by plastic material. For example, magnets formed of nitrile rubber embedded with particles of ferromagnetic material such as barrium ferrite, a material which is lighter in weight than metal magnets, has been found to be highly satisfactory. Magnets of this type may be cut to form the elongated magnet strips 11. These magnet strips may be polarized so that one half of each side constitutes one pole such as south, and the other half constitutes the other side, such as north. The two magnetic strips are oriented in a north-south confronting relation with their opposite sides in contact with their respective backing strips to entrance the magnetic force.

Each web portion and its magnet unit is encased in an abrasive member 12, each abrasive member includes a backing lamination 13 and an abrasive lamination 14. The abrasive members are capable of being folded to form confronting portions 15 covering the magnet strips 11, diverging portions 16 extending upwardly therefrom, folds 17 extending over the upper edges of the web portions 6, opposed exposed portions 18 covering the web portions and end portions 19 covering the ends of the magnet strips and backing strips.

The cleaner for cauterizing implements functions as follows:

The polarity of the magnet strips 11 is such that the confronting portions 15 of the abrasive members are held in mutual contact, the force of which is predetermined so that the confronting portions will separate and scrape opposite sides of a cauterizing knife, when the cauterizing knife is inserted therebetween, guided by the diverging portions 16. Usually the cauterizing knife is inserted crosswise to the web portions 6 and may, after entering between the abrasive members, be turned and drawn longitudinally therebetween, if desired. However, the cauterized material usually is confined to a region close to the tip of the knife so that end-wise insertion is sufficient.

Figure 4:
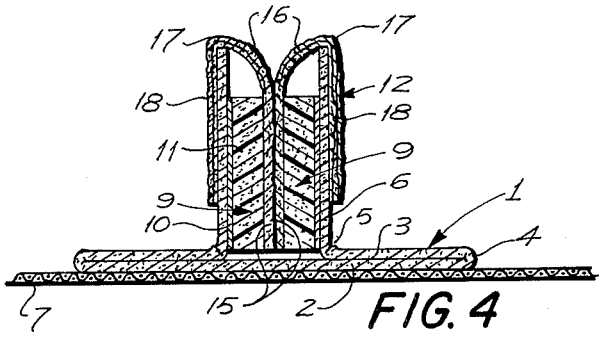
FIG. 4 is an enlarged transverse sectional view through 4—4 of FIG. 1.
Figure 2:
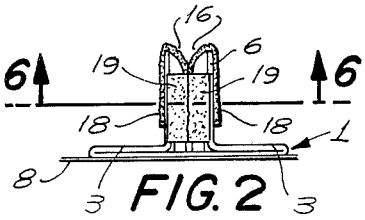
FIG. 2 is an end view thereof with the cleaner elements in their closed position.
Figure 5:
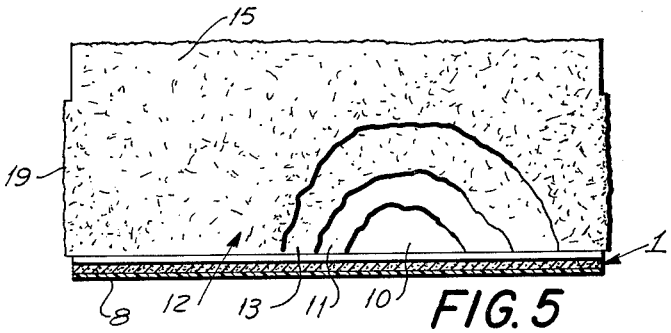
FIG. 5 is a longitudinal sectional view thereof taken through 5—5 of FIG. 1.
Figure 3:
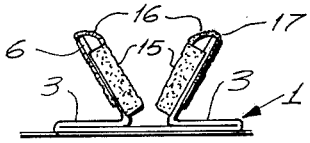
FIG. 3 is a similar end view showing the cleaner elements separated.

In many surgical operations involving cauterizing implements it is desirable to use a cauterizing forcep. Such implements have greater thickness than a cauterizing knife, requiring the web portions 6 to spread substantially, in some cases even to the extent as shown in FIG. 3. In this regard the magnet units serve an important function, for as the magnet units are separated the magnet force is reduced. This is desirable for, as indicated, the mounting member is secured to a surgical towel or drape 19 by the pressure sensitive adhesive 7, as indicated in FIG. 4. It is therefore essential that the surgical implement may engage and be cleaned by the cleaner without applying excessive force that would cause the cleaner to be dislodged from the surgical towel or drape. If it were not for the reduced attraction between the magnets, as occasioned by insertion of a cauterizing forcep, excessive force might be applied to the cleaner.

Referring to FIG. 3, while the magnetic force exerted between the upper portions of the magnet units reaches virtually zero there is still residual force between the lower portions of the magnets. In addition, the foldable connections 5 may be such as to exert a small force tending to urge the web portion 6 toward each other.

Figure 6:
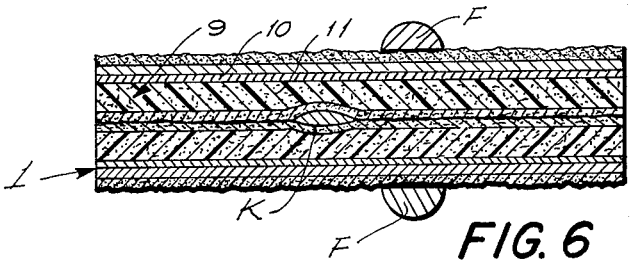
FIG. 6 is a longitudinal sectional view thereof taken through 6—6 of FIG. 2.
Figure 9:
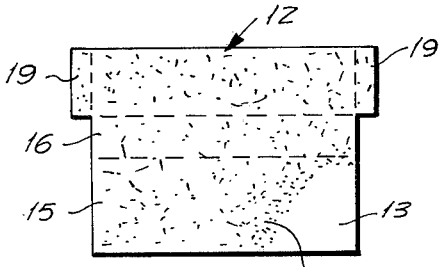
FIG. 9 is a developed view of one of the abrasive members.
Figure 7:
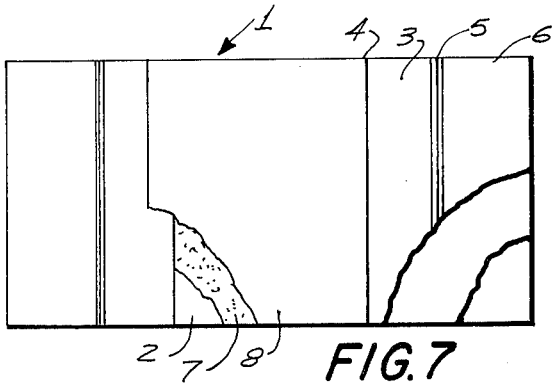
FIG. 7 is a bottom view of the mounting member before assembly.
Figure 8:
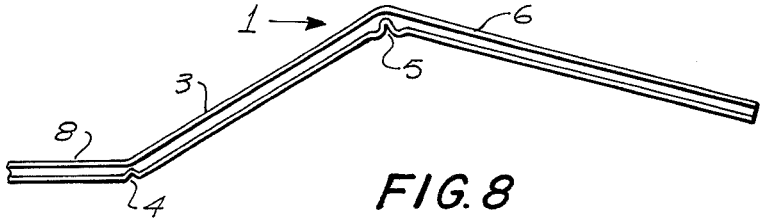
FIG. 8 is an edge view thereof.

In addition to using the confronting portions 15 of the abrasive members, as indicated by K in FIG. 6, the exposed portions 18 may also be used to clean a single blade type cautery, or to clean both arms of a forcep simultaneously, as indicated by F in FIG. 6.

Having fully described our invention it is to be understood that we are not to be limited to the details herein set forth, but that our invention is of the full scope of the appended claims.

We claim:

1. A cleaner for cauterizing implements, comprising:

a. a mounting member having a mounting surface and a pair of upstanding webs flexibly connected to the mounting member;

b. a pair of flat magnet units secured to confronting sides of the webs;

c. and a covering including abrasive material over the confronting sides of the magnet units;

d. the magnets exerting a mutually attractive force yieldably maintaining the abrasive coverings in mutual contact; said force diminishing on separation of the abrasive coverings upon insertion of a surgical implement therebetween.

2. A cleaner for cauterizing implements, as defined in claim 1, wherein:

a. the abrasive covering further includes diverging positions extending from the magnet over the webs, and exposed portions covering the remote surfaces of the webs.

3. A cleaner for cauterizing implements, as defined in claim 1, wherein:

a. the mounting member includes an underlying area;

b. and an initially protected pressure sensitive adhesive coats the underlying area.

4. A cleaner for cauterizing implements, as defined in claim 1, wherein:

a. the mounting member is formed of foldable sheet material, and includes a mounting panel, side portions folded thereover and joined to the webs by flexible connections exerting a minor force urging the webs toward each other to supplement the attractive force exerted by the magnets.

* * * * *